US005515765A

United States Patent [19]

Wilkinson

[11] Patent Number: 5,515,765

[45] Date of Patent: May 14, 1996

[54] METHOD OF MAKING ELECTRO-THERMAL CHEMICAL CARTRIDGE

[75] Inventor: G. Mark Wilkinson, San Diego, Calif.

[73] Assignee: Maxwell Laboratories, San Diego, Calif.

[21] Appl. No.: 450,566

[22] Filed: May 25, 1995

Related U.S. Application Data

[62] Division of Ser. No. 122,725, Sep. 16, 1993, Pat. No. 5,431,105.

[51] Int. Cl.[6] ..... F42B 33/00

[52] U.S. Cl. ..... 86/1.1; 29/1.3; 86/23

[58] Field of Search ..... 86/1.1, 10–12, 86/23; 102/202, 430–433, 440, 443, 466, 467, 472, 530, 531, 700; 29/1.3, 1.31, 1.82

[56] References Cited

U.S. PATENT DOCUMENTS

| | | | |
|---|---|---|---|
| 3,583,766 | 6/1971 | Padberg | 299/14 |
| 3,679,007 | 7/1972 | O'Hare | 175/16 |
| 4,334,474 | 6/1982 | Coltharp | 102/206 |
| 4,741,405 | 5/1988 | Moeny et al. | 175/16 |
| 4,895,062 | 1/1990 | Chryssomallis et al. | 89/7 |
| 4,897,577 | 1/1990 | Kitzinger | 315/55 |
| 4,974,487 | 12/1990 | Goldstein et al. | 89/7 |
| 5,012,719 | 5/1991 | Goldstein et al. | 89/8 |
| 5,052,272 | 10/1991 | Lee | 89/7 |
| 5,072,647 | 12/1991 | Goldstein et al. | 89/8 |
| 5,106,164 | 4/1992 | Kitzinger et al. | 299/14 |
| 5,287,791 | 2/1994 | Chaboki et al. | 89/8 |

FOREIGN PATENT DOCUMENTS

| | | |
|---|---|---|
| 0412895 | 2/1991 | European Pat. Off. . |
| 4003320 | 8/1991 | Germany . |
| 357345A | 7/1983 | U.S.S.R. . |

*Primary Examiner*—Harold J. Tudor
*Attorney, Agent, or Firm*—Fitch, Even, Tabin & Flannery

[57] ABSTRACT

An electrothermal chemical cartridge with a fuse of tapering cross section enables higher impulse energy to be imparted to a projectile by means of complete controlled burning of propellant. A long, narrow tube filled with propellant has a fuse on its inside surface with a cross section that tapers toward the discharge end, separated from the electrical ground of the cartridge casing by a layer of insulation sufficiently thin to be destroyed as the fuse ignites the propellant. A high-voltage electrode connected at the back end of the tube provides for application of a pulse of sufficient current density to ohmically heat or burn the fuse in a controlled fashion from the discharge end to the back end. Many such tubes can be bundled together in a large casing for wide barrel guns.

7 Claims, 5 Drawing Sheets

METHOD OF MAKING ELECTRO-THERMAL CHEMICAL CARTRIDGE

This is a division of application Ser. No. 08/122,725, filed Sep. 16, 1993, now U.S. Pat. No. 5,431.105.

FIELD OF THE INVENTION

The invention relates generally to means and methods for controlled ignition of propellants, and more particularly, to electrothermal chemical cartridges adapted for use in guns and the like, where ignition of a slow burning propellant is controlled by electrical activation of a tapered fuse.

BACKGROUND OF THE INVENTION

The effective delivery of thrust to a projectile in a gun, or a projectile in the form of a rocket or the like, depends upon control of the ignition of the propellant. It is desirable to cause the energy of the burning propellant to be delivered within the time of interest, namely the time in which the projectile is subject to thrust from the propellant. Yet a complete and instantaneous detonation of all the propellant is destructive to the gun and does not maximize thrust. Preferably, the pressure acting on the projectile is substantially constant, thereby achieving maximum acceleration for a given bore pressure tolerance.

According to the state of the art, ignition and burning of propellant in conventional cartridges is controlled by the geometry of propellant grains. The shape, size and degree of perforation of solid propellant grains controls the rate of combustion once the propellant has been ignited by a fuse. However, these factors limit the energy density which can be packed into a cartridge and subsequently delivered to the projectile. For example, the conventional propellant RDX used in the art has a density of about b 1.8grams per cubic centimeter. It is typically pelletized into cylindrical pellets having a diameter of ⅜ inch, and a length of ½ inch, and is perforated. As a result, in the pelletized form necessary for controlled burning on a millisecond time scale, RDX has a density of about 1 gram per cubic centimeter. Furthermore, desensitizing agents are typically added to the propellant to further slow or control the combustion, which reduce the density to about half of the original density of RDX.

A variation on the conventional cartridge is the bulk liquid propellant cartridge, where a less sensitive, but also less potent liquid propellant is loaded at full density. Here, combustion rate is controlled not by grain size, but by the growth of a "Taylor Bubble" representing the interface between gaseous burn products and the unburned liquid. Unfortunately, the evolution of the bubble involves turbulent fluid dynamics as well as instability growth, and thus is not reproducible.

As an alternative to conventional cartridges, it is been attempted in the art to initiate and control the burning of propellant by means of electricity. Such cartridges have the potential to deliver far more impulse power than do conventional chemical cartridges because a higher energy density can be packed into the cartridge, and thrust can be delivered in a more timely and constant fashion to the projectile by means of the added control provided by electric current.

One method known in the art for burning propellant under the control of electric current requires striking an electric arc within one or more capillaries embedded in the propellant. Some measure of control is provided by the intensity of radiation impinging upon the ignited propellant, since the brightness may be controlled via the electric current. However, the degree of control is inversely dependent upon the ratio of chemically-generated to electrically-supplied energy. At one extreme is a conventional gun whose propellant has been ignited with an arc. This produces high efficiency, but with a burn rate determined entirely by the propellant. At the other extreme, all of the energy is provided electrically. This produces complete control over the pressure pulse, and allows one to choose an inert propellant of low molecular weight, allowing high velocities to be achieved. However, the efficiency with which the electrical energy is used to produce projectile kinetic energy is then very low.

Many electrically controlled designs suffer from some of the same problems as conventional liquid propellant cartridges, namely intrinsic irreproducibility in the dynamics of turbulent mixing and flame propagation over the distances involved in the cartridge. This means that while the supply of electrical energy is easily controlled, this control is negated in these designs by the random dynamics of propagating combustion fronts, plasma discharges or electrically-injected sprays.

For example, according to another method in the art, a propellant comprising two reactive components is ignited locally by using an electric arc to vaporize and then spray a fog of one atomized component into the other component locally. A number of such localized spray-type injections permits control of the propagation of the reaction throughout the cartridge. However, the electrical input requirements to obtain adequate mixing are considerable in this system, and it is thus not energy efficient. Furthermore, the system is unreliable and complicated because the spray dynamics are random and unreliable, and therefore achieve varying degrees of mixing between the two components.

In yet another method in the art, as described in U.S. Pat. No. 4,974,487 to Goldstein et al., a projectile is accelerated along a bore by plural plasma jet sources, located at different longitudinal positions along the length of the bore, and in the cartridge at the rear of the bore. The plasma jet is initiated in a low molecular weight dielectric material located in a discharge capillary with electrodes at each end. The plasma builds up a pressure through ohmic dissipation of its energy and passes through a fluid which may also be vaporized to contribute to the pressure front which propels the projectile. Disadvantageously, the device is subject to problems with the random and irreproducible dynamics of the plasma and its mixing with the fluid. While the current delivered to the capillary can be controlled, the behavior of the plasma in releasing the pressure build-up, the mixing of the plasma with the fluid, and the resulting vaporization of a component of the fluid are highly chaotic and problematic. Furthermore, in common with the other alternatives described above, a large amount of electrical energy is required to achieve the necessary plasma flow rates.

In a related device, described in U.S. Pat. No. 5,072,647 to Goldstein et al., a projectile is accelerated in response to high pressure gas such as hydrogen, generated in an exothermic reaction of a slurry of water and metal particles, initiated by a plasma discharge. The pressure of the hydrogen gas is maintained as the projectile accelerates down the gun bore by increasing the electric power applied to the plasma discharge. However, this design also suffers from the plasma dynamics problems associated with the aforementioned U.S. Pat. No. 4,974,487.

In U.S. Pat. No. 5,052,272 to Lee, an electric pulse is applied to a metallic wire to explode the wire into a slurry of aluminum particles in water, thereby igniting the slurry. Electrical energy continues to flow through the slurry and thereby augment the reaction. By these means the aluminum-water mixture is substantially reacted in the time of interest. However, no provision is made to control the rate of the reaction using electric current once the discharge of the ignition current is started. The exothermic reaction of the aluminum and hydrogen is promoted by the discharging electric pulse, without consideration of the position and rate of the reaction front. Furthermore, all of the propellant in the cartridge is reacted at once, leading to the same problems with the dynamics of flame propagation which plague the other aforementioned devices.

While the general concept of electrothermal chemical cartridges promises great improvement over conventional cartridges in the efficient and timely delivery of thrust to a projectile in a gun or rocket or the like, there is a need for a reliable means of using electric current to control the ignition of propellant. In particular, a cartridge is needed that avoids the problems associated with turbulent dynamics, has a reasonable electrical energy delivery efficiency, and performs reliably. It is furthermore desirable that such a cartridge be comparatively simple and cost-effective to construct.

The present invention advantageously addresses the above and other needs.

SUMMARY OF THE INVENTION

The invention provides an improved electrothermal chemical (ETC) cartridge having a tapered fuse, that uses electricity to ignite and control the combustion of a high-energy, slow-burning chemical propellant. A long, narrow tube having a grounded conductive exterior surface is substantially packed full of propellant, which is locally combusted progressively from the front discharge end to the back end of the tube by the ohmic heating or molten bursting of a solid metallic fuse which runs the length of the inside surface of the tube. The propellant produces pressure which escapes through the discharge end to propel a projectile. The cross-sectional area of the fuse material tapers toward the discharge end, so that a given current provided through the fuse material by the discharge of a pulse of electricity between a high-voltage electrode connected at the back end of the tube and the conductive outer surface heats and bursts the fuse-material having smaller cross sectional area first. The ignition front thus starts at the discharge end and progresses toward the back end as the fuse reaches ignition temperatures and/or bursts.

Advantageously, the narrow aspect of the tube ensures complete combustion of the propellant locally by the bursting fuse material, without the problems of the dynamics of turbulent mixing. Because the propellant is slow burning compared to the ignition rate of the fuse material, the progression of the ignition front from the discharge end to the back end of the tube is completely controlled by the fuse, and provides for orderly combustion of the propellant. This effectively eliminates the counterproductive effects of overpressure as might be encountered if all of the propellant were reacted at once, or of stochastic flame propagation if a plasma is used only to ignite the propellant in a small region.

The propellant is preferably a slurry of a metal and an oxidant such as water, which burns slowly compared to the rate of consumption of the fuse, but is highly exothermic, producing low atomic weight gases at high temperatures and pressures.

A layer of insulation between the fuse material and the grounded outer surface of the tube is sufficiently thin that it is destroyed locally as the propellant is locally ignited by ohmic heating of the fuse material to ignition temperature, or as the fuse material bursts. Spent fuse material which might otherwise continue to drain electrical energy is thereby shorted out to the grounded outer surface, allowing for deposition of more electrical energy in unspent fuse material.

A single such tube may serve as a cartridge, or many such tubes may advantageously be bundled together in a casing to provide a cartridge for wider barrel guns. The construction of the cartridge is simple and cost efficient. The performance of the cartridge is reliable since it does not rely on fluid-type propagation of the ignition front, which is prone to fluctuations due to turbulent dynamics.

It is an object of the invention to provide an electrothermal chemical cartridge that uses electricity to ignite and control the combustion of a slow-burning propellant, in an orderly and reliable fashion, to provide timely delivery of tremendous thrust to a projectile.

It is a further object of the invention to provide a cartridge which avoids the problems associated with turbulent mixing and flame propagation which plague the prior art, by fully controlling the combustion of the propellant with an electrically controlled tapering solid fuse in a propellant-containing tube of narrow aspect.

It is yet another object of the invention to include a thin insulation layer in the cartridge between the fuse material and conductive exterior which is destroyed by the bursting fuse or combusting propellant so that the ignition front can effectively travel down the length of the cartridge.

It is yet another object of the invention to provide a cartridge which is simple and cost-effective to construct.

The above and still further objects, features and advantages of the invention will become apparent upon consideration of the following detailed description of specific embodiments, in conjunction with the accompanying drawings.

BRIEF DESCRIPTION OF THE DRAWINGS

The above and other aspects, features and advantages of the present invention will be more apparent from the following more particular description thereof, presented in conjunction with the following drawings wherein.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
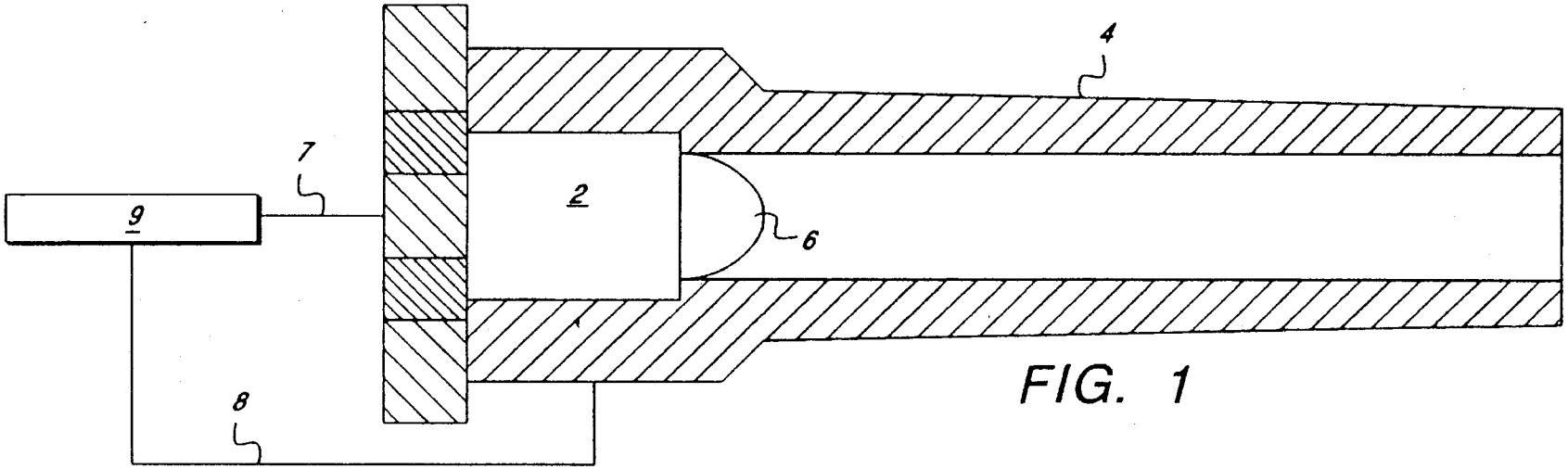
FIG. 1 is a sectional view of a gun employing the cartridge of the present invention.

FIG. 1 generally shows the employment of a cartridge 2 according to the present invention in a gun 4. High pressure gas generated upon ignition of the propellant in the cartridge 2 propels projectile 6 out of the gun 4. Conductive leads 7 and 8 provide electrical ignition current to the cartridge fuse from a high-voltage electrical power source 9. Lead 7 connects to a conductive electrode at the back of the cartridge, while lead 8 may connect to a portion of the outer surface of the gun, which is metallic and conductive. A current path therefore exists for discharging an ignition pulse through lead 7 to the electrode in the back of the cartridge, through the fuse material in the cartridge to the conductive casing of the cartridge and then to the metallic barrel of the gun and finally to lead 8. Alternatively, lead 8 may be grounded, and the current path may lead from the metallic outer surface of the gun generally to ground.

According to one embodiment of the present invention described in detail below, the cartridge for use in a wide barrel gun such as that shown in FIG. 1 comprises a plurality of narrow, propellant-filled ignition tubes bundled together. In small bore guns, the cartridge may comprise just one such tube.

Figure 2:
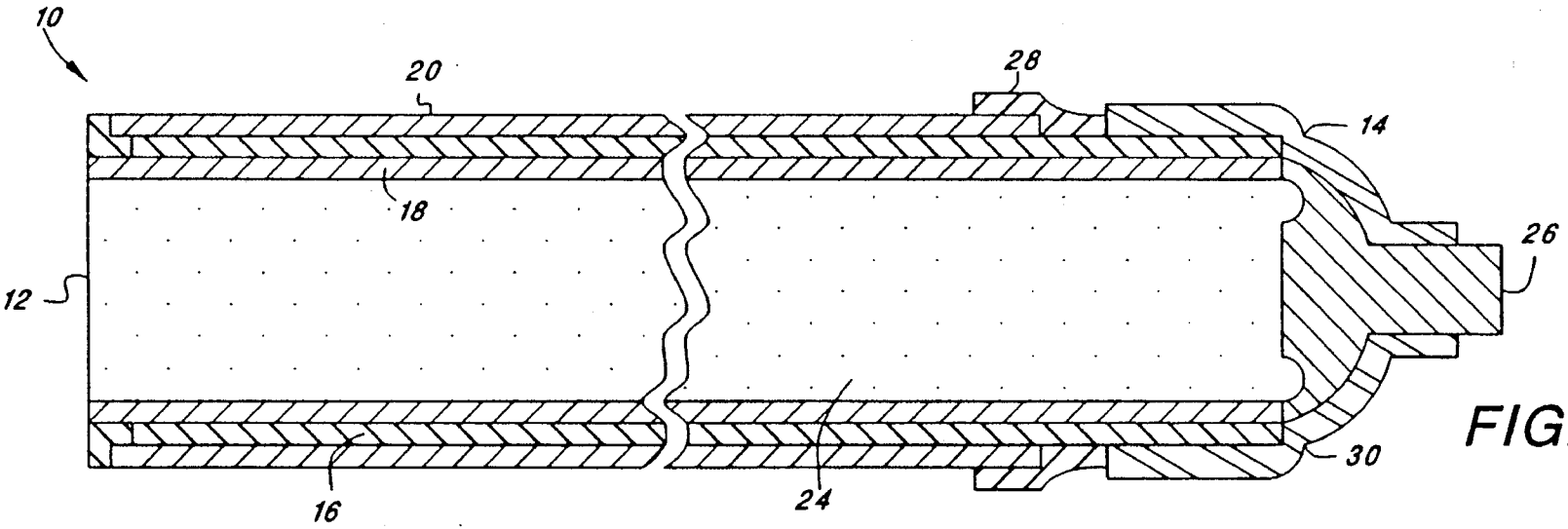
FIG. 2 is a sectional view of a long single-tube cartridge according to the present invention, where a long center section has been omitted as indicated by a jagged interruption.

With reference to FIG. 2, an electrothermal chemical cartridge 10 according to the present invention is tubular and has a long and narrow aspect, which is indicated in the figure by a jagged interruption in the center of the cartridge representing a long, unshown center section. The cartridge has a discharge end 12 and a back end 14, and a projectile to be shot from a gun barrel receives force from the discharge end of the cartridge. The cartridge further comprises an insulation layer 16, a fuse 18 on the inner surface of the insulation layer, and a conductive layer 20 on the outer surface of the insulation layer. A propellant 24 substantially fills the volume of the tube.

The propellant is preferably one which generates low molecular weight gases such as hydrogen, and more particularly comprises a metal or metal hydride in combination with an oxidant. Most particularly, the propellant is aluminum in a particulate form suspended in water containing a gelling agent to prevent the aluminum from settling out. Such a mixture is ignited in the range of about 1000° C. to 2000° C., which may be achieved by attaining such a temperature range in the fuse material, which is typically a metallic material which melts or bursts in this temperature range. Ammonium nitrate may advantageously be added to the mixture to lower the threshold ignition temperature to the range of about 300° C. to 400° C. Using such a mixture it is possible to achieve ignition without bursting the metallic fuse material.

The cartridge 10 is long so that the time required for the propellant to burn from the discharge end to the back end, if ignited only at one end, is long compared to the time frame for bursting the fuse material. However, the cartridge is sufficiently narrow that complete transverse combustion of the propellant occurs in a time which is short compared to this time of interest. Longitudinal combustion of the propellant is thus controlled by heating and/or burning of the fuse 18.

Heating to a specified temperature or bursting of the fuse material for propellant ignition is achieved by attaining a critical combination of electrical current density and duration of application of the electrical current in the fuse material. Electrical current is provided by means of a high-voltage electrode 26, preferably located at the back end 14 of the cartridge and in electrical contact with the fuse. Current flows via the electrode 26, through the fuse material, and to conductive layer 20, which is connected to electrical ground, and with which the fuse is in contact at the discharge end 12, as may be seen in the figure. The cross sectional area of the fuse 18 tapers from the back end 14 to the discharge end 12, so that for a given current flow, current density in the fuse material increases toward the discharge end 12. As a consequence, electrical energy density will attain the critical threshold in the fuse toward the discharge end first, causing local heating or bursting of the fuse and local ignition of the propellant, and progress subsequently toward the back end in a controlled fashion, depending on the degree of tapering, the fuse material used, and the current available, among other factors.

Insulation layer 16 separates the fuse 18 from the conductive layer 20 at ground potential for the length of the cartridge except at the discharge end, where the fuse 18 and conductive layer 20 come in contact around the end of the insulation layer. When a high voltage is applied to electrode 26, current flows through the fuse material and into the conductive layer. Because the cross sectional area of the fuse material is smallest at the discharge end, current density is highest at the discharge end, causing this fuse material to heat more rapidly, possibly to a bursting temperature, igniting the propellant. If the propellant is of a type which is ignited only at very high temperatures such as the melting point or boiling point of the metallic fuse material, this material is turned to a molten or vaporized state, and is destroyed locally. If the propellant is of a type which ignites at a temperature lower than either the melting or boiling point of the metallic fuse material, the fuse material is destroyed locally by the explosive force of the locally ignited propellant.

As the fuse material of smallest cross sectional area is locally burst or destroyed, it is effectively removed from the electrical ignition circuit, as described below, and the current density achieves its maximum value in the fuse material immediately adjacent the destroyed section, having a cross sectional area slightly larger than had the destroyed section, but smaller than any other remaining section of the fuse. In this fashion, the location of the maximum current density in the unspent fuse material, and thus the ignition front, moves progressively from the discharge end to the back end.

According to the invention, insulation layer 16 must be sufficiently thin that it disintegrates upon bursting of the adjacent fuse material or local combustion of the propellant accompanied by local destruction of the adjacent fuse material. In this way, as the ignition front of the fuse material progresses from the discharge end to the back end, the insulation material is destroyed along with it, and the end of the unspent fuse material is placed in contact with the outer conductive layer to permit continued current flow, or is placed sufficiently close to the conductive layer to permit arcing of current and thus continued ignition of the propellant.

Advantageously, the present invention thereby avoids the problem that, as fuse material bursts, it typically may remain at a high resistance, and thereby sink much of the electrical energy deposited by the current, interfering with or preventing the vaporization of other unspent fuse material. Since the insulation layer is destroyed locally upon bursting of the fuse material, the spent fuse remnant is shorted out to the newly-exposed portion of the conductive layer 20, and thus does not sap electrical energy from the vaporization front.

As may further be seen in FIG. 2, conductive layer 20 desirably does not extend completely to the back end of the cartridge where the electrode 26 is located. This prevents possible arcing of current from the electrode directly to the conductive layer, which would circumvent the fuse and therefore defeat the effectiveness of the invention. An insulating jacket 28 may be provided over the end of the conductive layer for added insulation against arcing. An insulating support 30 envelops the high-voltage electrode 26 and the end of the cartridge to provide electrical isolation from the gun barrel or other objects, and support to the entire assembly.

More particularly, the fuse 18 may comprise a contiguous layer coating the entire inner surface of the insulation layer 16, where the thickness of the fuse layer decreases from the back end to the discharge end. Alternatively, the fuse may comprise a plurality of parallel strips running the length of the inner surface of the insulation layer, spaced equally around the circumference, where the width of each strip diminishes from the back end to the front end but the thickness remains the same. The fuse material may comprise any metallic material known in the art to heat ohmically and ultimately burst upon application of a sufficient electrical current density, and may be attached to the inner surface of the insulation layer by any method to which said material is amenable, as is well known in the art, including, but not limited to deposition, extrusion and etching.

Similarly, conductive layer 20 may comprise any sufficiently conductive metal, and may be applied to the outer surface of the insulation layer 16 by any of a number of well known methods, including deposition, extrusion, etching and wrapping.

Figure 3:
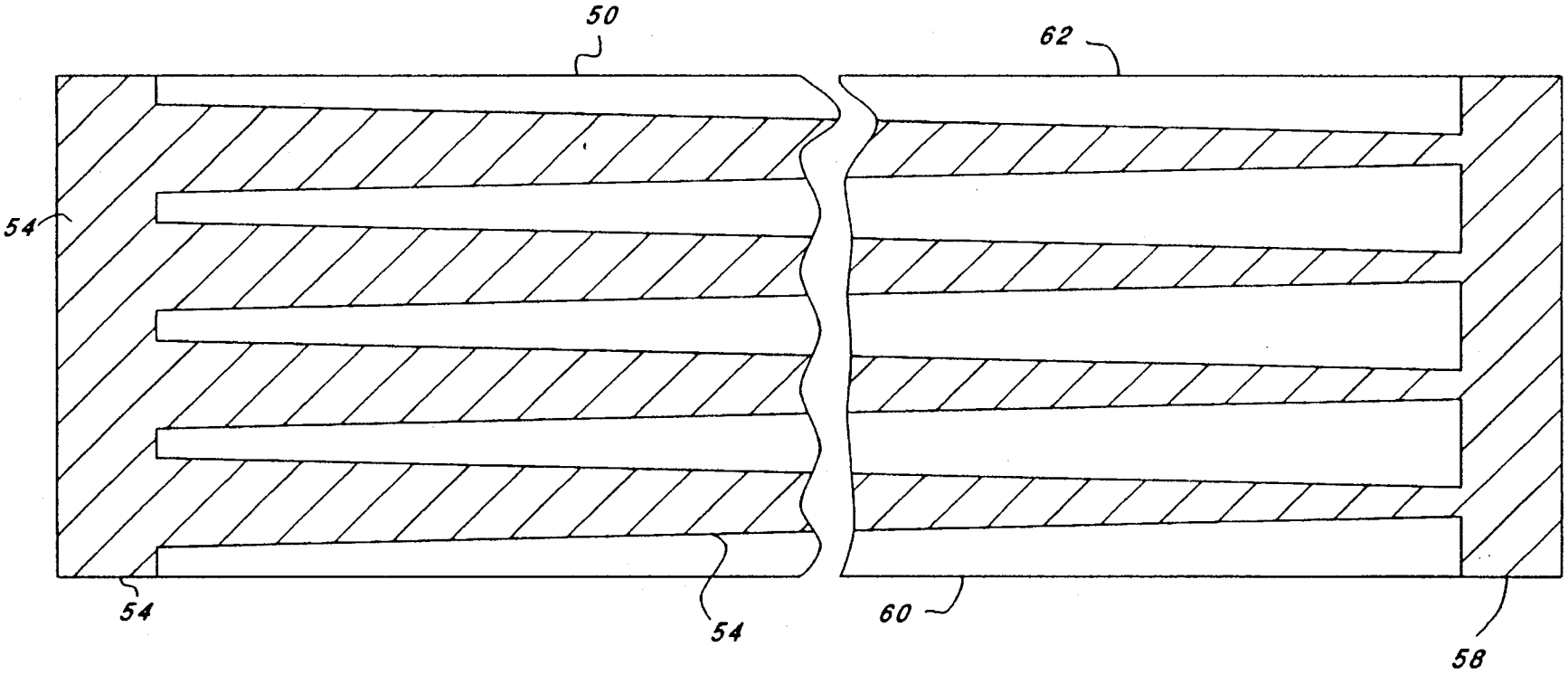
FIG. 3 is a perspective view of a long sheet of insulation with an etched layer of metal thereon, where a long center section has been omitted as indicated by a jagged interruption.

A preferable embodiment of the present invention may be understood with reference to FIG. 3, wherein is shown a sheet 50 of Kapton insulation, laminated with a layer 52 of copper. The sheet is long, as indicated in the figure by a jagged interruption in the center of the sheet representing a long, unshown center section. The copper lamination is etched using circuit board etching techniques well known in the art to produce a pattern comprising a plurality of parallel strips 54 which taper from one end to the other. The thickness of the Kapton insulation is preferably about 5 millimeters, and the thickness of the copper lamination is preferably in the range of about 1 millimeter to about 3 millimeters. The copper strips 54 are contiguously joined at both ends by bands 56 and 58. Band 56 is located at what will comprise the back end of the cartridge, and is used to connect to the high-voltage electrode, while band 58 is located at what will comprise the discharge end of the cartridge. Band 58 serves to structurally support the sheet, but is not necessary for the invention, and as an alternative the copper strips 54 may extend to the edge of the Kapton sheet without being joined by any such band.

The presence of the band 58 at the discharge end does not defeat the effect of the tapered fuse strips 54. While a critical current density for achieving an ignition temperature may never occur in band 58, it will occur substantially near the discharge end just prior to the band 58, where the strips are thinnest. As described above, when local ignition is achieved at this location of the thinnest width, the fuse material is destroyed, and adjacent fuse material in the strips is put in contact with the outer conductive surface. Band 58 is then effectively removed from the electrical circuit, and does not contribute to the remainder of the process.

Figure 4:
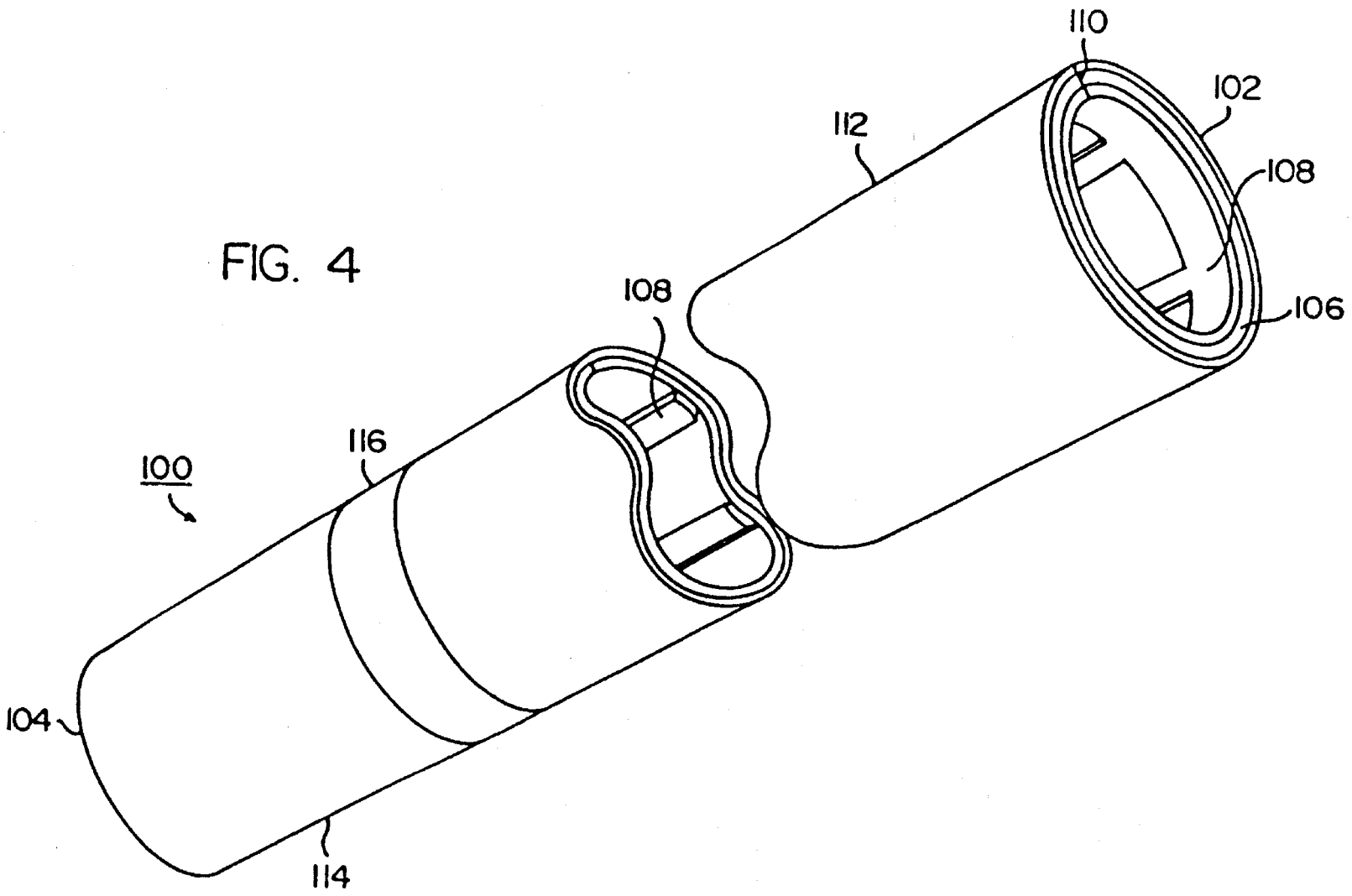
FIG. 4 is a perspective view of a tube for use in a cartridge according to one embodiment of the present invention, where a long center section has been omitted as indicated by a jagged interruption.

The sheet of laminated and etched insulation is formed into a long tube by joining edges 60 and 62. The resulting tube 100, shown in FIG. 4, is long and narrow, which is indicated in the figure by a jagged interruption in the center of the tube representing a long, omitted center section. Tube 100 has a discharge end 102 and a back end 104. The tube comprises a Kapton insulation layer 106, on the inner surface of which is found fuse strips 108, the width of each of which tapers toward the discharge end 102. The tube may be made by rolling the Kapton insulation sheet 50 around a cylindrical mandrel, by way of example. It is joined at edges 60 and 62 by a longitudinal strip of adhesive Kapton tape or the like applied along the joint 110.

The tube has a conductive layer 112 which may be provided by overwrapping with a sheet of aluminum foil having a thickness of about 0.13 mm (0.005 inches), by way of example. The foil layer 112 preferably terminates about 10 centimeters from the back end 104 of the tube to prevent direct arcing of current from the electrode to the conductive layer, leaving an area 114 of the insulation layer exposed. The edge of the foil layer 112 is further insulated to prevent arcing to the edge from the electrode by wrapping an adhesive strip 116 of Kapton insulation or the like around the circumference of the tube over the foil edge. While omitted for clarity in the figure, it is to be understood that the conductive foil has a length extending beyond the edge of the discharge end which may serve as a flap to be wrapped around the discharge end and placed in contact with the fuse material on the inside surface of the tube. Alternatively, a separate piece of copper tape is applied around the top edge of the tube, connecting the inside, fuse layer with the outside conductive layer.

According to another embodiment of the present invention, a plurality of tubes such as that shown in FIG. 4 may be bundled together in a casing and provided with a single high-voltage electrode, for wide barrel guns. It is preferable to pack such a plurality tightly into the casing, and to this end, the tubes may be shaped to tightly and substantially fill all the space of a cylindrical casing.

Figure 5:
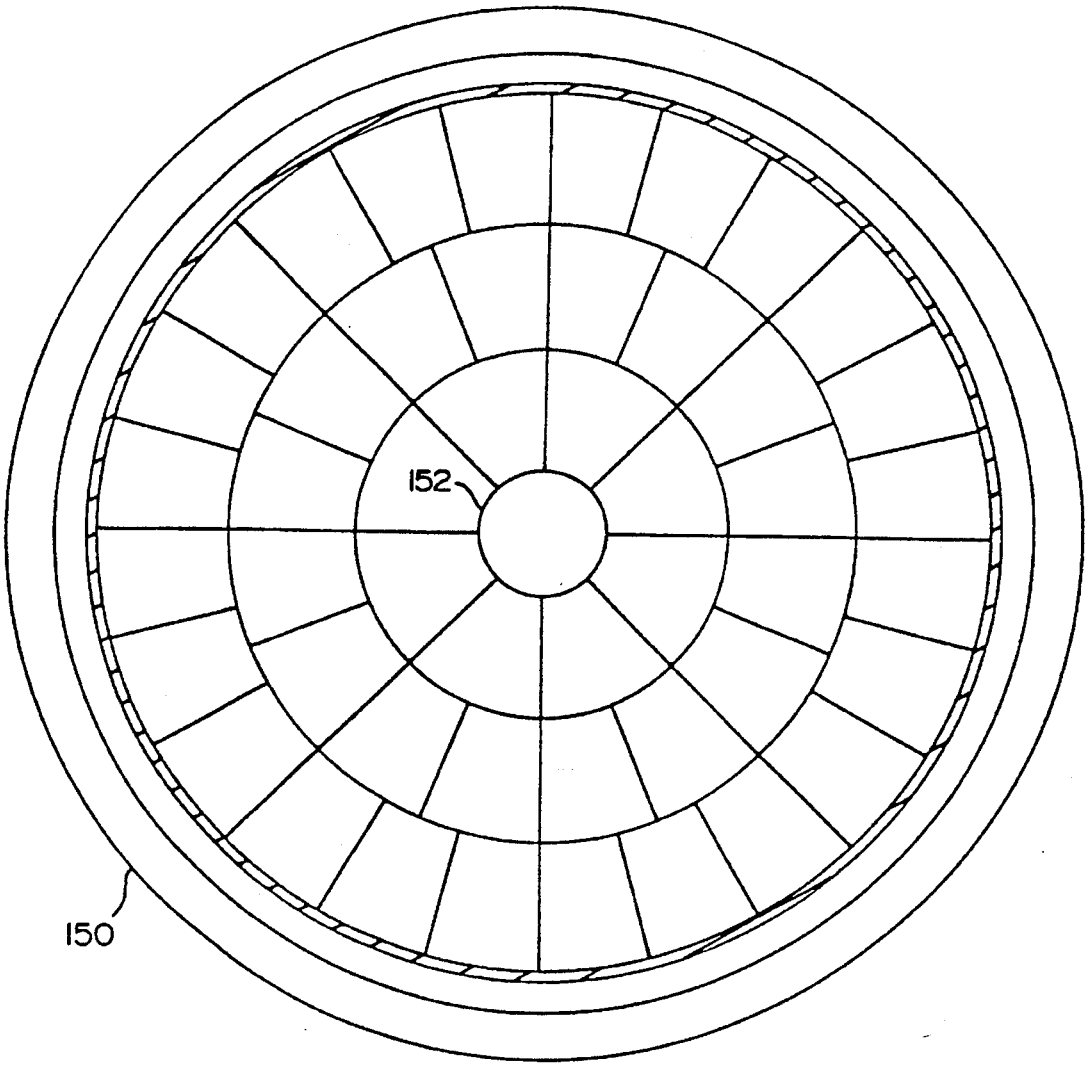
FIG. 5 is an end view of a multiple-tube cartridge according to another embodiment of the present invention.

FIG. 5 is an end view showing one configuration for packing tubes into a casing tightly with substantially no open space between the tubes. Casing 150 contains forty-nine tubes, of which forty-eight tubes have been shaped to have trapezoidal-like cross sections, and one tube 152 is shaped cylindrically. While the shapes of the tubes need not be identical, it is desirable to maintain axial symmetry in the configuration. For a 132 mm diameter projectile, an etched copper laminated Kapton sheet as described above may first be rolled around a 0.75 inch diameter cylindrical mandrel, and have three fuse strips 108. Cylindrical tubes may then be shaped to have trapezoidal-like or other cross sections by sliding them over appropriately shaped mandrels.

Figure 6:
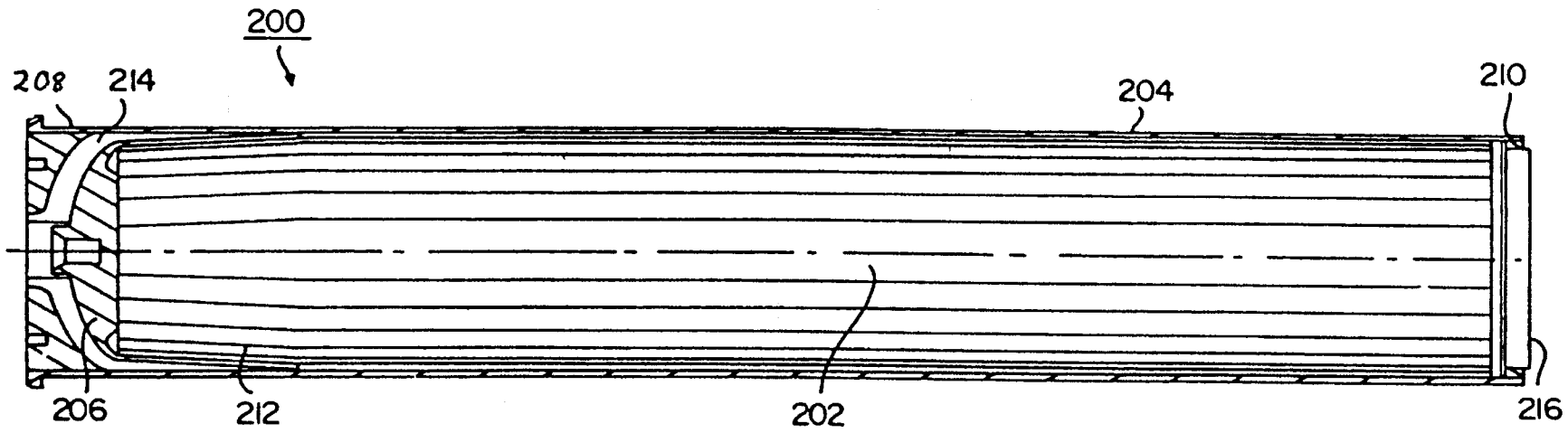
FIG. 6 is a partially sectional view of the multiple-tube cartridge of FIG. 5.

A multiple tube cartridge 200 is shown in FIG. 6 in partial sectional view, where the bundled tubes 202 are not shown sectioned, but the casing 204, high-voltage electrode 206 and other components are. The cartridge 200 has a back end 208 and a discharge end 210. The casing 204 is metallic, to provide structural support and to provide electrical ground contact for the conductive surfaces of tubes 202. Compression and slight deformation of the bundle of tubes 202 by insertion into the casing 204 ensures a good ground connection as they are pressed against the metal shell casing 204. Deformation to an extent such as that visible in the figure in section 212 of the cartridge provides this connection while not markedly impairing the operation of the cartridge.

A tapered, cup-shaped insulator 214, preferably made from Lexan polycarbonate, available from General Electric Co., or high modulus polyurethane insulates the high voltage electrode 206 from the grounded shell casing 204, as well as extends the required electrical breakdown length beyond the location of the back ends of the tubes 202. The shape of the insulator 214 provides a high pressure gas seal at the interface with the inside of the cartridge, as well as the outer edge of the electrode.

Cartridge 200 may be constructed by first shaping the tubes 202 which comprise the bundle on mandrels, according to the configuration shown in FIG. 5. The tubes are then bundled together and the back ends of the bundled tubes are immersed in a pool of molten solder contained within the bowl-shaped copper electrode 206. After the solder cools, the insulator cap 214 is glued over the electrode at the back end of the bundle and the assembly is inserted into a 5-inch gun shell casing 204, compressing the tubes and insulator cap at the back end of the cartridge to form the aforementioned seal. The 5-inch gun shell is modified by milling to have a removable back base plate, which may be screwed back into place. Adhesives may be used for further sealing the cartridge as known in the art. The back steel base plate is then screwed into the back end of the casing, over the insulator cap and electrode. Propellant is added to the tubes to a desired level from the discharge end. The propellant is typically a mixture of 50% water, 50% aluminum powder having an average particle diameter of about 3 microns, and a small amount of gelling agent. The size and shape of the aluminum powder particles may be varied to control the burn rate; in particular aluminum flakes of less than 1 micron thickness may be used. Additionally, ammonium nitrate may be added to the slurry to substantially lower the ignition threshold temperature. Finally, the cartridge is sealed from the front end by stamping and caulking a thin aluminum cap 216 in place.

Electrical power at high voltage and current is provided to the electrode through the likes of a firing pin hole as may be found in a conventional gun. The electrical power source may be an inductor, a capacitor bank, a homopolar generator, a magneto hydrodynamic power source driven by explosives, or a rotating flux compressor. Preferably a capacitor bank is used which is able to deliver a current pulse of about 5 millisecond duration, attaining a peak current in the range of 120,000 to 500,000 amps.

While the invention herein disclosed has been described by means of specific embodiments and applications thereof, numerous modifications and variations could be made thereto by those skilled in the art without departing from the scope of the invention set forth in the claims.

What is claimed is:

1. A method for making an electro-thermal chemical cartridge comprising the steps of:

attaching a plurality of parallel fuse strips of a suitable conductive material having tapered widths on a sheet of insulation;

forming said sheet into a tube, said tube having an inner surface, an outer surface, a discharge end and a back end, with said fuse strips running along the length of the inner surface of said tube and extending from the discharge end to the back end;

covering a substantial length of the outer surface of the tube with a conductive material;

connecting a high-voltage electrode to said fuse strips at their wide ends; and filling said tube with a propellant.

2. A method according to claim 1, comprising the further step of covering an end of the conductive material on the outer surface of said tube closest to the electrode with an insulating material.

3. A method according to claim 1, wherein the propellant comprises aluminum particles suspended by a gelling agent in water.

4. A method according to claim 1, wherein the propellant comprises aluminum particles and ammonium nitrate suspended by a gelling agent in water.

5. A method according to claim 1, comprising the further step of bundling a plurality of said tubes together in an outer casing.

6. A method according to claim 1, comprising the further step of shaping said tubes such that they substantially fill all the volume of the casing.

7. A method according to claim 1, wherein the step of attaching a plurality of parallel fuse strips on a sheet of insulation further comprises the step of etching a plurality of parallel fuse strips having tapered widths on a sheet of insulation laminated with copper.

* * * * *